US007131430B2

(12) United States Patent
Rado et al.

(10) Patent No.: US 7,131,430 B2
(45) Date of Patent: Nov. 7, 2006

(54) EMISSIONS CONTROL SYSTEM FOR SMALL INTERNAL COMBUSTION ENGINES

(75) Inventors: Gordon E. Rado, Plymouth, WI (US); David R. Brower, Beaver Dam, WI (US); Dennis N. Stenz, Mount Calvary, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/656,305

(22) Filed: Sep. 4, 2003

(65) Prior Publication Data

US 2004/0123846 A1 Jul. 1, 2004

Related U.S. Application Data

(60) Provisional application No. 60/409,485, filed on Sep. 10, 2002.

(51) Int. Cl.
*F02M 37/04* (2006.01)

(52) U.S. Cl. ..... 123/525; 123/520

(58) Field of Classification Search ..... 123/525, 123/520, 516

See application file for complete search history.

(56) References Cited

U.S. PATENT DOCUMENTS

| | | | | |
|---|---|---|---|---|
| 3,258,254 A | | 6/1966 | Jakob | 261/36 |
| 3,547,415 A | | 12/1970 | Perry | 261/50 |
| 3,572,659 A | | 3/1971 | Kizlauskas | 261/43 |
| 3,578,293 A | | 5/1971 | Santi | 261/64 |
| 3,645,244 A | | 2/1972 | Seyfarth | 123/136 |
| 3,752,134 A | | 8/1973 | Hollis, Jr. | 123/136 |
| 3,931,368 A | | 1/1976 | Barker et al. | 261/36 A |
| 3,935,850 A | | 2/1976 | King | 123/136 |
| 3,952,719 A | * | 4/1976 | Fenton et al. | 123/198 DB |
| 4,044,743 A | * | 8/1977 | Eaton | 123/520 |
| 4,212,276 A | * | 7/1980 | Kaneda | 123/519 |
| 4,237,926 A | | 12/1980 | Walker | 137/565.13 |
| 4,270,504 A | * | 6/1981 | Sciotti et al. | 123/520 |
| 4,306,531 A | * | 12/1981 | Watkins | 123/525 |
| 4,462,945 A | | 7/1984 | Brown et al. | 261/50 R |
| 4,540,103 A | | 9/1985 | Kasugai et al. | 220/203 |
| 4,765,504 A | | 8/1988 | Sherwood et al. | 220/86 R |
| 4,932,444 A | | 6/1990 | Micel | 141/59 |
| 4,953,583 A | | 9/1990 | Szlaga | 137/118 |
| 4,982,715 A | | 1/1991 | Foster | 123/518 |
| 5,054,508 A | | 10/1991 | Benjey | 137/43 |

(Continued)

*Primary Examiner*—Stephen K. Cronin
*Assistant Examiner*—Jason Benton
(74) *Attorney, Agent, or Firm*—Baker & Daniels

(57) ABSTRACT

An evaporative emissions control system for small internal combustion engines includes a control valve associated with a fuel line and with a vent line which each connect the fuel tank to the carburetor. When the engine is not running, the control valve automatically closes the vent line and the fuel line, thereby trapping fuel vapors within the fuel tank and vent line and preventing the supply of liquid fuel to the carburetor. Upon engine start up, actuation of a bail assembly or vacuum produced within the carburetor causes the control valve to open the vent line and the fuel line, venting fuel vapors from the fuel tank through the fuel line to the carburetor for consumption by the engine, and opening the supply of liquid fuel from the fuel tank to the carburetor. Also, the present evaporative emissions control system may be used in conjunction with one or more fuel tank sealing and venting assemblies, which prevent the escape of fuel vapors from the fuel tank into the atmosphere, yet which allow fluid exchange in a closed manner between the fuel tank and carburetor.

40 Claims, 5 Drawing Sheets

U.S. PATENT DOCUMENTS

| | | | | |
|---|---|---|---|---|
| 5,183,173 | A | 2/1993 | Heckman | 220/367 |
| 5,259,412 | A | 11/1993 | Scott et al. | 137/588 |
| 5,275,145 | A * | 1/1994 | Tuckey | 123/521 |
| 5,279,439 | A | 1/1994 | Kasugai et al. | 220/203 |
| 5,348,177 | A | 9/1994 | Sung | 220/86.2 |
| 5,375,633 | A | 12/1994 | Bucci | 141/59 |
| 5,482,024 | A * | 1/1996 | Elliott | 123/516 |
| 5,540,347 | A | 7/1996 | Griffin | 220/203.23 |
| 5,687,762 | A | 11/1997 | Teets et al. | 137/588 |
| 5,868,121 | A * | 2/1999 | Brown et al. | 123/526 |
| 6,058,913 | A | 5/2000 | Busato et al. | 123/520 |
| 6,234,153 | B1 * | 5/2001 | DeGroot et al. | 123/525 |
| 6,314,947 | B1 * | 11/2001 | Roche | 123/525 |
| 6,640,770 | B1 | 11/2003 | Woody | 123/198 D |
| 6,959,696 | B1 | 11/2005 | Shears et al. | 123/516 |
| 2002/0112701 | A1 | 8/2002 | Gracyalny et al. | 123/516 |
| 2002/0139355 | A1 | 10/2002 | Gracyalny et al. | 123/516 |
| 2003/0111062 | A1 | 6/2003 | Brandenburg et al. | 123/516 |

* cited by examiner

EMISSIONS CONTROL SYSTEM FOR SMALL INTERNAL COMBUSTION ENGINES

CROSS REFERENCE TO RELATED APPLICATIONS

This application claims the benefit under Title 35, U.S.C. § 119(e) of U.S. Provisional Patent Application Ser. No. 60/409,485, entitled EMISSIONS CONTROL SYSTEM FOR SMALL INTERNAL COMBUSTION ENGINES, filed on Sep. 10, 2002.

BACKGROUND OF THE INVENTION

1. Field of the Invention.

The present invention relates to small internal combustion engines of the type used with lawnmowers, lawn tractors, and other utility implements. In particular, the present invention relates to emissions control systems for such engines.

2. Description of the Related Art.

Small internal combustion engines of the type used with lawnmowers, lawn tractors, and other small utility implements typically include an intake system including a carburetor attached to the engine which mixes liquid fuel with atmospheric air to form a fuel/air mixture which is drawn into the engine for combustion.

One known type of carburetor includes a fuel bowl containing a supply of liquid fuel therein which is drawn into the throat of the carburetor to mix with atmospheric air. A float within the fuel bowl actuates a valve which meters liquid fuel into the fuel bowl from a fuel tank. In another known type of carburetor, a diaphragm pump attached to the crankcase of the engine is actuated by pressure pulses within the engine to pump fuel from a fuel tank into a fuel chamber within the carburetor, from which the fuel is drawn into the throat of the carburetor to mix with atmospheric air. The foregoing carburetors are usually vented to the atmosphere such that the pressure within the fuel bowl or fuel chamber is at atmospheric pressure.

In each of the foregoing arrangements, the carburetor is attached via a fuel line to a fuel tank, which stores a quantity of liquid fuel therein. The fuel tank includes a filler neck through which fuel may be filled into the fuel tank, and a fuel tank cap is attached to the filler neck to close the fuel tank. The fuel tank cap usually includes venting structure therein for allowing any pressurized fuel vapors within the fuel tank to vent through the fuel tank cap to the atmosphere. Also, the venting structure allows atmospheric air to enter the fuel tank from the atmosphere as necessary to displace volume within the fuel tank as the fuel within the fuel tank is consumed by the engine.

A problem with the existing intake and fuel supply systems of such small internal combustion engines is that fuel vapors may escape therefrom into the atmosphere, such as from the carburetor or from the fuel tank.

What is needed is a fuel supply system for small internal combustion engines which prevents the escape of fuel vapors into the atmosphere, thereby controlling and/or substantially eliminating fuel vapor emissions from such engines.

SUMMARY OF THE INVENTION

The present invention provides an evaporative emissions control system for small internal combustion engines. A control valve is associated with a fuel line and with a vent line which each connect the fuel tank to the carburetor, and is operable responsive to vacuum produced in the carburetor or to actuation of a bail assembly, for example. When the engine is not running, the control valve automatically closes the vent line and the fuel line, thereby trapping fuel vapors within the fuel tank and vent line and preventing the supply of liquid fuel to the carburetor. Upon engine start up, vacuum produced within the carburetor, or actuation of a bail assembly, causes the control valve to open the vent line and the fuel line, venting fuel vapors from the fuel tank through the fuel line to the carburetor for consumption by the engine, and opening the supply of liquid fuel from the fuel tank to the carburetor. The control valve may be operable to first open at least a portion of the vent line to vent the fuel vapors before the fuel line is opened. Also, the present evaporative emissions control system may be used in combination with one or more fuel tank sealing and venting assemblies, which prevent the escape of fuel vapors from the fuel tank into the atmosphere, yet allow fuel vapor and air exchange in a closed manner between the fuel tank and carburetor.

The control valve may include a valve housing in which a valve member is slidably disposed, the valve member normally biased by a spring within the valve housing to a first position in which both the vent line and the fuel line are closed by the valve member. The valve housing is in communication with the throat of the carburetor, such that vacuum produced within the carburetor upon engine start-up is communicated to the interior of valve housing, shifting the valve member against the bias of the spring to open the vent line and the fuel line. Alternatively, the valve member may be actuated by a bail assembly of the implement with which the engine is used, through a cable connection between the bail assembly and the valve member. The valve member may be configured such that at least a portion of the vent line is first opened before the fuel line is opened, thereby venting any trapped fuel vapors from the fuel tank to the carburetor before the fuel line is opened. The control valve may comprise a separate component mounted to the engine, or alternatively, the control valve may comprise a portion of the carburetor itself.

Fuel tank sealing and venting arrangements are disclosed for sealing the fuel tank in order to prevent escape of fuel vapors therefrom to the atmosphere, yet which permit exchange of vapors and/or air in a closed manner between the fuel tank and the carburetor. In one embodiment, a filler neck of the fuel tank includes a vent passage formed therein which communicates the fuel tank to the carburetor. A fuel tank cap is sealingly attached to the filler neck to prevent fuel vapors from escaping therethrough to the atmosphere. The fuel tank cap includes a vent assembly operable when the fuel tank cap is attached to the filler neck to permit passage of fuel vapors and air therethrough and to prevent passage of liquid fuel therethrough.

In a second embodiment, an add-on vent assembly is attached to the filler neck of the fuel tank, and cooperating locking structure between the vent assembly and the fuel tank secures the vent assembly to the fuel tank. A fuel tank cap is attached to the vent assembly to seal the fuel tank and prevent the escape of fuel vapors therethrough to the atmosphere. The vent assembly includes a valve having a floating ball and a valve seat. The valve is operable to permit passage of fuel vapors from the fuel tank to the carburetor, and also to allow passage of air from the carburetor into the fuel tank as necessary. The ball floats on any liquid fuel which may enter the valve, seating against the valve seat and closing the valve, thereby preventing liquid fuel from passing therethrough to the carburetor.

Advantageously, the present invention provides an evaporative fuel emissions control system for small internal combustion engines which prevents escape of fuel vapors from the fuel supply and intake system of the engine to the atmosphere.

In one form thereof, the present invention provides an internal combustion engine, including a carburetor; a fuel tank; a fuel line and a vent line each fluidly communicating the fuel tank and the carburetor; and a control valve including a valve member movable between a first position in which the valve member prevents fluid communication between the fuel tank and the carburetor through at least one of the fuel line and the vent line, and a second position in which the valve member allows fluid communication between the fuel tank and the carburetor through the fuel line and the vent line.

In another form thereof, the present invention provides a carburetor, including a carburetor body having a throat; a fuel inlet; a vent inlet; and a control valve including a valve member movable between a first position in which the valve member prevents fluid communication through at least one of the fuel inlet and the vent inlet and a second position in which the valve member allows fluid communication through the fuel inlet and the vent inlet.

In a further form thereof, the present invention provides a method of operating an internal combustion engine including a fuel tank and a carburetor, including the steps of opening a control valve contemporaneously with starting the engine to allow fluid communication between the fuel tank and the carburetor through a vent line and through a fuel line; and closing the control valve contemporaneously with engine shut down to prevent communication between the fuel tank and the carburetor through at least one of the vent line and the fuel line.

In a still further form thereof, the present invention provides an internal combustion engine, including an intake system; a fuel tank including an inlet, a fuel passage, and a vent passage, the fuel passage and the vent passage each fluidly communicating the fuel tank with the intake system; a fuel tank cap removably attached to the inlet and preventing passage of fluid from the fuel tank to the atmosphere.

In a still further form thereof, the present invention provides an internal combustion engine, including an intake system; a fuel tank having an inlet and containing liquid fuel and fuel vapors therein; a vent assembly attached to the inlet, the vent assembly in fluid communication with the intake system and including a fuel-responsive valve normally disposed in a first position and allowing passage of fuel vapors from the fuel tank to the intake system, the valve responsive to contact with liquid fuel to move to a second position in which passage of liquid fuel from the fuel tank to the intake system is prevented; and a removable fuel tank cap sealingly attached to the vent assembly, whereby liquid fuel and fuel vapors from the fuel tank are prevented from passing from the fuel tank to the atmosphere.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1A:
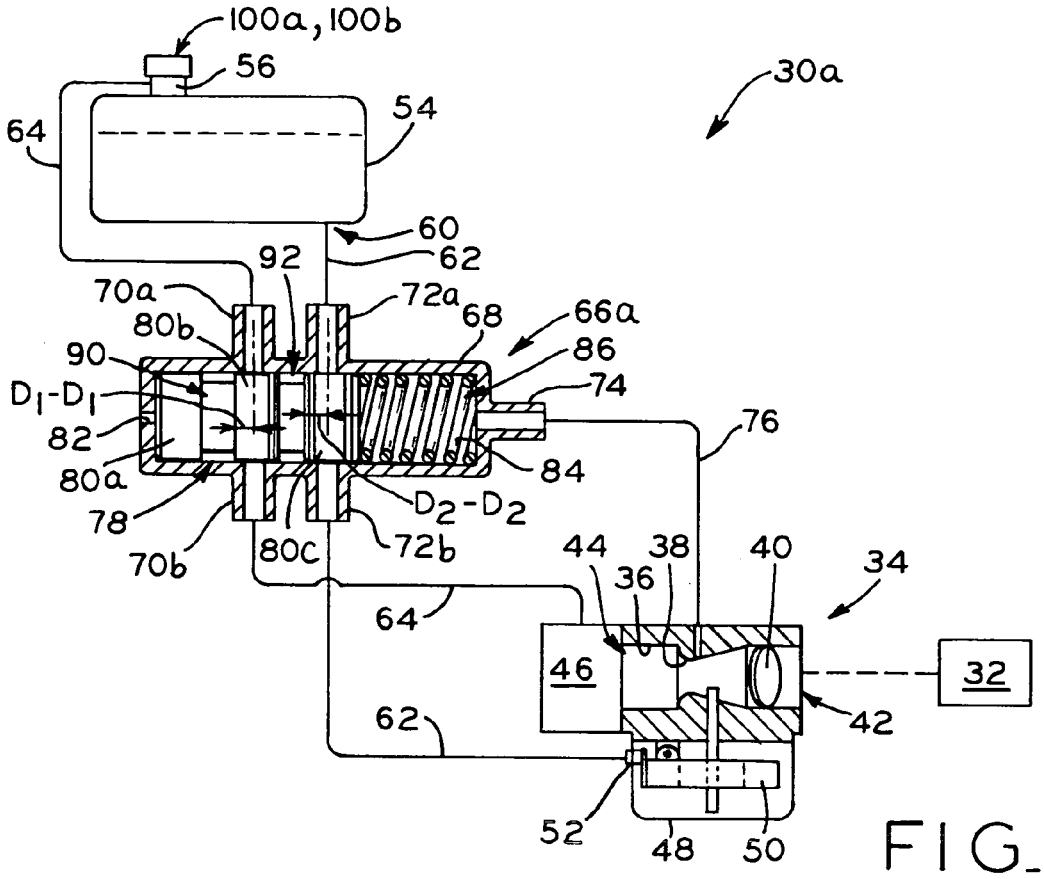
FIG. 1A is a schematic view of an evaporative emissions control system according to a first embodiment of the present invention, showing the control valve thereof in a closed position.
Figure 1B:
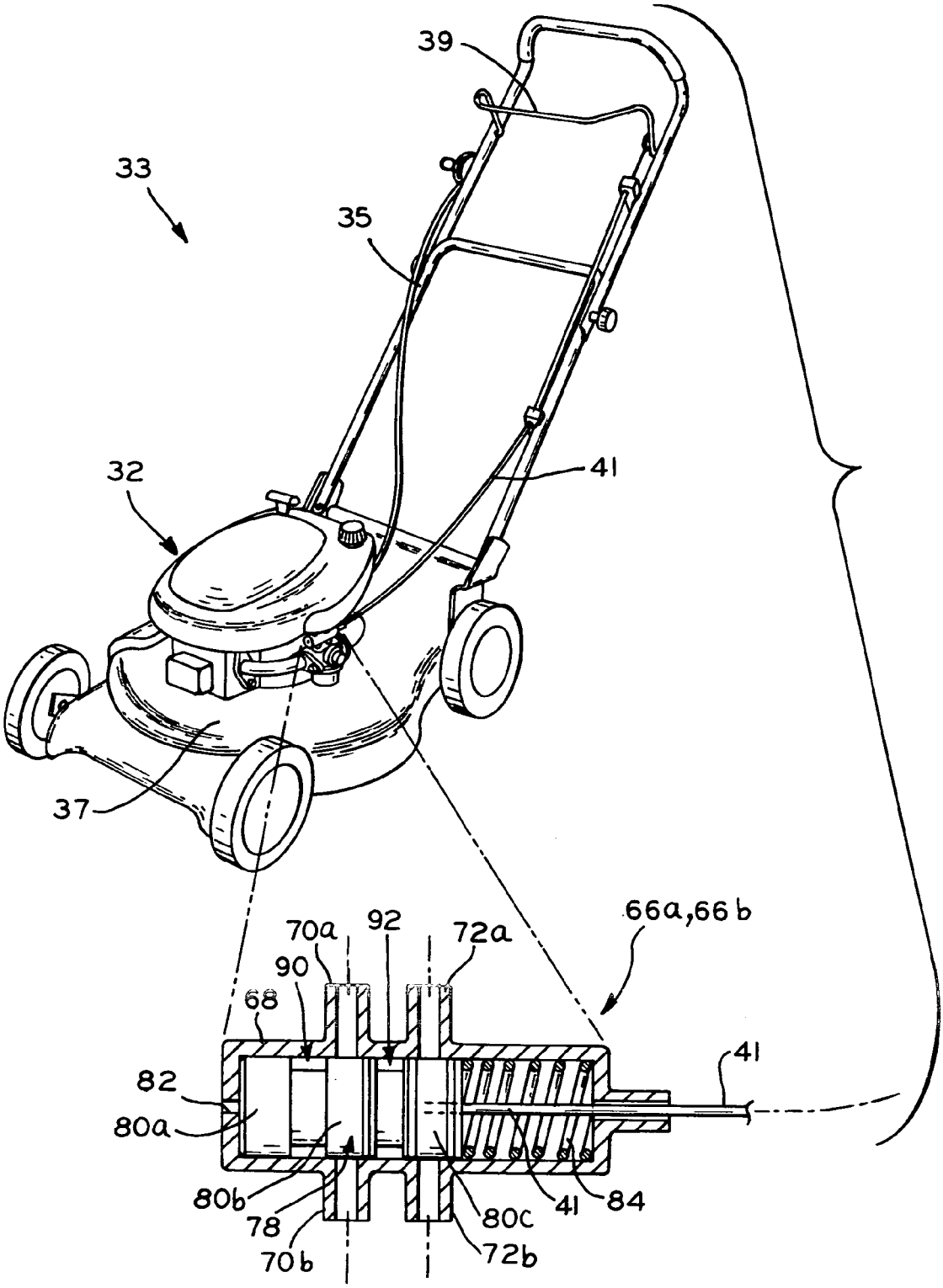
FIG. 1B is a perspective view of a lawnmower having a bail assembly for actuating the control valve of the present invention according to an alternative manner.

Evaporative emissions control system 30*a* according to a first embodiment is schematically shown in FIG. 1A associated with engine 32. Engine 32 may be a small internal combustion engine, such as a single or twin cylinder engine having either a vertical or a horizontal crankshaft, wherein engine 32 is of the type used with lawnmowers, lawn tractors, other utility implements, or in sport vehicles. As shown in FIG. 1B, for example, engine 32 is used with lawnmower 33.

Referring back to FIG. 1A, the intake system of engine 32 includes carburetor 34 having throat 36 with venturi 38 and throttle valve 40 therein, as well as outlet 42 in communication with the intake port (not shown) of engine 32, and inlet 44 to which air filter 46 is attached. Carburetor 34 further includes fuel bowl 48 containing a quantity of liquid fuel therein which, when engine 32 is running, is drawn into throat 36 of carburetor 34 by the vacuum within throat 36 in a conventional manner to mix with atmospheric air, thereby forming an air/fuel mixture which is drawn into for engine 32 for combustion. Float 50 floats on the fuel within fuel bowl 48, and is operatively connected to bowl valve 52 to meter the supply of liquid fuel into fuel bowl 48 from fuel tank 54.

Fuel tank 54 may be mounted to engine 32, or alternatively, may be located remotely from engine 32, and includes filler neck 56 through which fuel may be filled into fuel tank 54. Fuel within fuel tank 54 is communicated through fuel outlet 60 of fuel tank 54 and fuel line 62 to fuel bowl 48 of carburetor 34. Vent line 64 connects fuel tank 54 to the inlet side 44 of carburetor 34. For example, vent line 64 is shown in FIG. 1A attached to air filter 46. Alternatively, vent line 64 may also be connected between air filter 46 and inlet 44 of carburetor 34, or may be connected directly to inlet 44 of carburetor 34, such as to the air horn of throat 36 of carburetor 34. Filler neck 56 of fuel tank 54 includes a fuel tank sealing and venting assembly 100*a* or 100*b* associated therewith, which are described in detail further below. Generally, fuel tank sealing and venting assemblies 100*a* and 100*b* are operable to prevent the escape of fuel vapors from fuel tank 54 into the atmosphere, while permitting either fuel vapors to pass from fuel tank 54 to carburetor 34 or air to pass from carburetor 34 to fuel tank 54, as necessary.

Control valve 66*a* is associated with vent line 64 and with fuel line 62, and generally includes housing 68 having several connection ports, including vent line ports 70*a* and 70*b* to which vent line 64 is attached, fuel line ports 72*a* and 72*b* to which fuel line 62 is attached, and vacuum line port 74 to which vacuum line 76 is attached. Vacuum line 76 is also connected to carburetor 34, and communicates throat 36 of carburetor 34 with control valve 66*a*. Housing 68 includes valve member 78 slidable therein, and valve member 78 includes shoulders 80*a*, 80*b*, and 80*c*, each of which may be provided with one or more O-rings 88 as necessary for sealingly engaging the interior wall of housing 68 of control valve 66. Vent hole 82 is disposed within housing 68 adjacent shoulder 80*a* of valve member 78. Return spring 84 is disposed within vacuum chamber 86 of control valve 66*a*, which is defined between shoulder 80*c* of valve member 78 and housing 68 adjacent vacuum line port 74.

Figure 2:
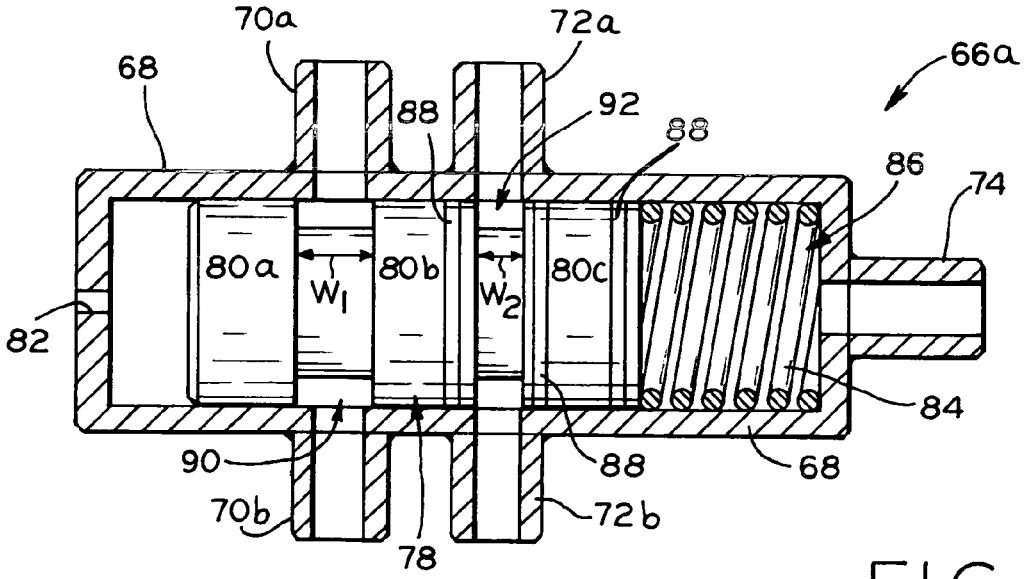
FIG. 2 is a sectional view of the control valve of the evaporative emissions control system of FIG. 1A, the control valve in an open position.

As shown in FIG. 2, valve member 78 includes vent recess 90 defined between shoulders 80*a* and 80*b* thereof, having a first width $W_1$, and also includes fuel recess 92 defined between shoulders 80*b* and 80*c* thereof, having a second width $W_2$ which is less than first width $W_1$ of vent recess 90. Also, as shown in FIG. 1A, the distance $D_1$—$D_1$ between the left edge of shoulder 80*b* and the centers of vent line ports 70*a* and 70*b* is less than a corresponding distance $D_2$—$D_2$ between the left edge of shoulder 80*c* and the centers of fuel line ports 72*a* and 72*b*. In this manner, when valve member 78 slides to the right in FIG. 1A against the bias of return spring 84, as further described below, vent line port 70*a* communicates with vent line port 70*b* via vent recess 90 to thereby open vent line 64 before fuel line port 72*a* communicates with fuel line port 72*b* via fuel recess 92 to open fuel line 62.

When engine 32 is not running, return spring 84 biases valve member 78 to the left within housing 68 as shown in FIG. 1A, such that shoulder 80*b* blocks communication between vent line ports 70*a* and 70*b*, and shoulder 80*c* blocks communication between fuel line ports 72*a* and 72*b* to thereby close vent line 64 and fuel line 62, respectively, between fuel tank 54 and carburetor 34. In this manner, any fuel vapors within fuel tank 54 are not allowed to escape into the atmosphere, and are contained within fuel tank 54 and vent line 64, and similarly, liquid fuel is prevented from passing from fuel tank 54 to fuel bowl 48 of carburetor 34 through fuel line 62.

Upon engine startup, a vacuum is immediately formed within throat 36 of carburetor 34, which vacuum is communicated through vacuum line 76 to vacuum chamber 86 of control valve 66*a*, thereby shifting valve member 78 to the right as shown in FIG. 2 against the bias of return spring 84. As valve member 78 is shifted, air may enter housing 68 of control valve 66 through vent hole 82 to occupy the expanding volume between housing 68 and shoulder 80*a* of valve member 78. Due to the fact that distance $D_1$—$D_1$ is less than the distance $D_2$—$D_2$ as described above, vent line 64 is opened before fuel line 62, such that any vapors within fuel tank 54 and vent line 64 are immediately vented through control valve 66*a* to inlet 44 of carburetor 34 before fuel line 62 is opened to communicate fuel tank 54 with fuel bowl 48 of carburetor 34. Alternatively, distances $D_1$—$D_1$ and $D_2$—$D_2$ may be configured such that vent line 64 and fuel line 62 are opened simultaneously, or such that fuel line 62 is opened before vent line 64. When control valve 66*a* opens vent line 64, fuel vapors which pass into inlet 44 of carburetor 34 are mixed with intake air which is drawn through air filter 46, and also with fuel from fuel bowl 48 to form an air/fuel mixture which is consumed within engine 32.

Upon shutdown of engine 32, vacuum is no longer present within throat 36 of carburetor 34 for communication through vacuum line 76 to vacuum chamber 86 of control valve 66*a*, thereby allowing return spring 84 to bias valve member 78 to the closed position shown in FIG. 1A, closing vent line 64 and fuel line 62. As valve member 78 is biased by return spring 84, air between housing 68 and shoulder 80*a* of valve member 78 is vented to the atmosphere through vent hole 82. As discussed above, the closing of valve member 78 traps fuel vapors within fuel tank 54 and vent line 64, and prevents the supply of liquid fuel from fuel tank 54 through fuel line 62 to fuel bowl 48 of carburetor 34.

Figure 3:
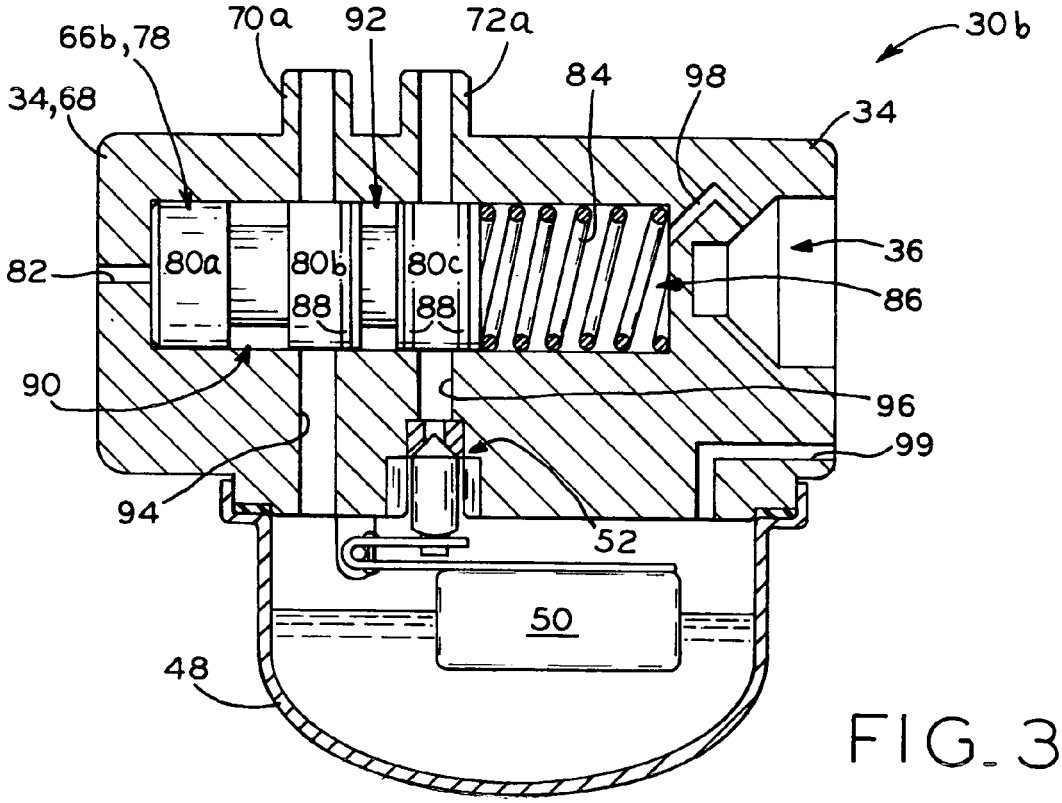
FIG. 3 is a sectional view of a carburetor according to a second embodiment of the present invention, showing the control valve thereof in a closed position.
Figure 4:
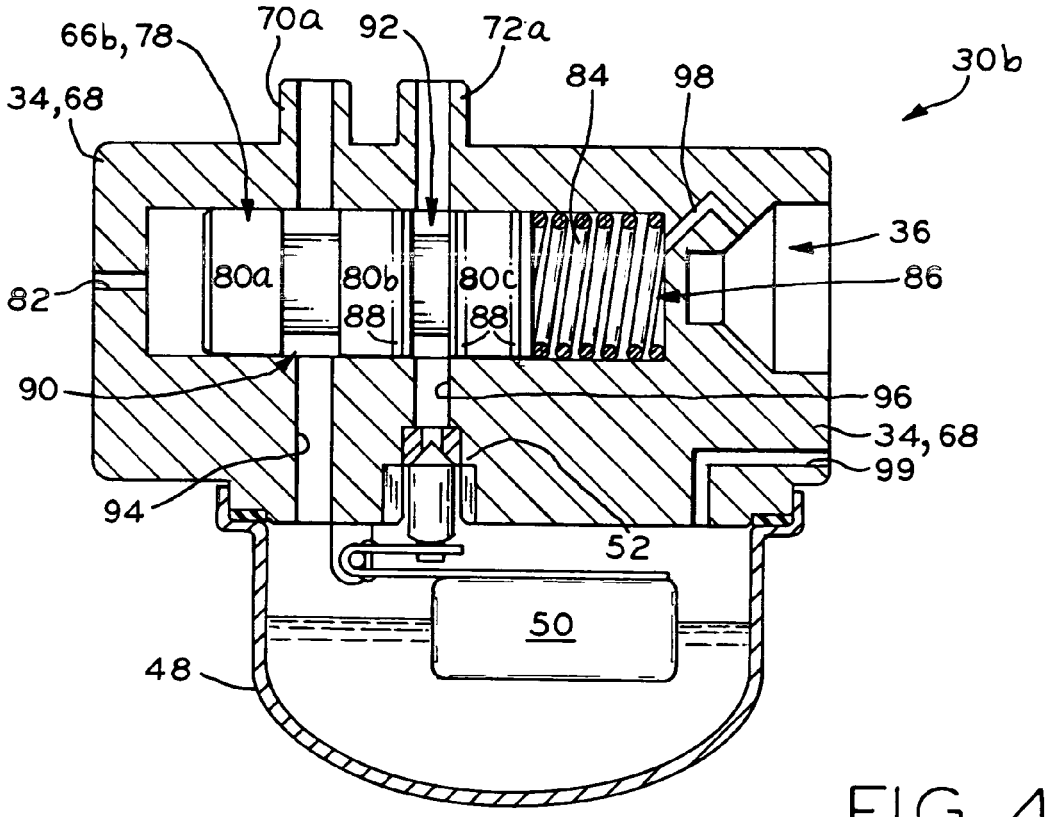
FIG. 4 is a sectional view of the carburetor of FIG. 3, showing the control valve thereof in an open position.

Referring to FIGS. 3 and 4, there is shown evaporative emission control system 30*b* according to a second embodiment, wherein like structural elements between evaporative emission control system 30*a* of FIGS. 1 and 2 and evaporative emission control system 30*b* of FIGS. 3 and 4 are given identical reference numerals. Generally, evaporative emission control system 30*b* includes control valve 66*b* which is configured such that same comprises a portion of carburetor 34. Housing 68 of control valve 66*b* may be integrally formed with the body of carburetor 34 as shown in FIGS. 3 and 4, wherein control valve 66*b* is disposed on one side of throat 36, for example. Alternatively, housing 68 of control valve 66*b* may be attached to carburetor 34 as an add-on component. Control valve 66*b* includes vent passage 94 within carburetor 34 communicating control valve 66*b* to fuel bowl 34, and fuel passage 96 within carburetor 34 also communicating control valve to fuel bowl 34. Additionally, vacuum chamber 86 of control valve 66*b* is communicated to throat 36 of carburetor 34 through vacuum passage 98 formed within carburetor 34.

In operation, control valve 66*b* of evaporative emission control system 30*b* functions in a similar manner as control valve 66*a* of evaporative emission control system 30*a*. Specifically, upon actuation or opening of control valve 66*b*, fuel vapors from fuel tank 54 may pass through vent line 64 and control valve 66*b* into the headspace above the fuel in fuel bowl 48 of carburetor 34, and liquid fuel may pass from fuel tank 54 through fuel line 62 and control valve 66*b* into fuel bowl 48 of carburetor 34. Carburetor 34 may also include internal vent passage 99 communicating fuel bowl 48 with throat 36 or intake 44 of carburetor 34 such that excess fuel vapors within fuel bowl 48 may pass into throat 36 of carburetor for consumption by engine 32. Advantageously, because vent line 64 is in communication with fuel bowl 48, any liquid fuel which might enter vent line 64 from fuel tank 54 is carried to fuel bowl 48. Additionally, air from the atmosphere may enter fuel bowl 48 through throat 36 and internal vent passage 99, and thereafter through control valve 66*b* and vent line 64 as necessary, in order to displace volume within fuel tank 54 as the liquid fuel within fuel tank 54 is consumed by engine 32.

In the embodiments described above, control valves 66*a* and 66*b* are actuated upon engine start-up responsive to vacuum produced in carburetor 34. According to another embodiment shown in FIG. 1B, control valves 66*a* and 66*b* may also be actuated just before engine start-up using a bail assembly on the implement with which engine 32 is used. In FIG. 1B, engine 32 is used with an exemplary implement, shown as lawnmower 33, which includes handle assembly 35 mounted to deck 37. Bail assembly 39 is mounted to an upper end of handle assembly 35, and is grasped by an operator of lawnmower 33 before starting engine 32 to enable the ignition control system (not shown) of engine 32. Cable 41 is connected between bail assembly 39 and valve member 78 of control valve 66*a* or 66*b*. When an operator of lawnmower 33 gasps bail assembly 39, cable 41 is translated, and moves valve member 78 against the bias of return spring 84 to thereby actuate control valve 66*a* or 66*b* in the manner described above. Thereafter, the operator may start engine 32 using a recoil starter (not shown), for example.

In FIGS. 5–7 and 8–10, two embodiments for fuel tank sealing and venting assemblies 100*a* and 100*b* are shown, respectively, which are usable with either of the evaporative emissions control systems 30*a* and 30*b* described above. Generally, fuel tank sealing and venting assemblies 100*a* and 100*b* are operable to prevent fuel vapors from escaping fuel tank 54 into the atmosphere. Fuel tank sealing and venting assemblies 100*a* and 100*b* also allow fuel vapors within fuel tank 54 to pass therethrough into vent line 64, and/or air to pass through vent line 64 from carburetor 34 into fuel tank 54 to occupy the volume within fuel tank 54 formed by consumption of fuel from fuel tank 54 by engine 32.

Figure 5:
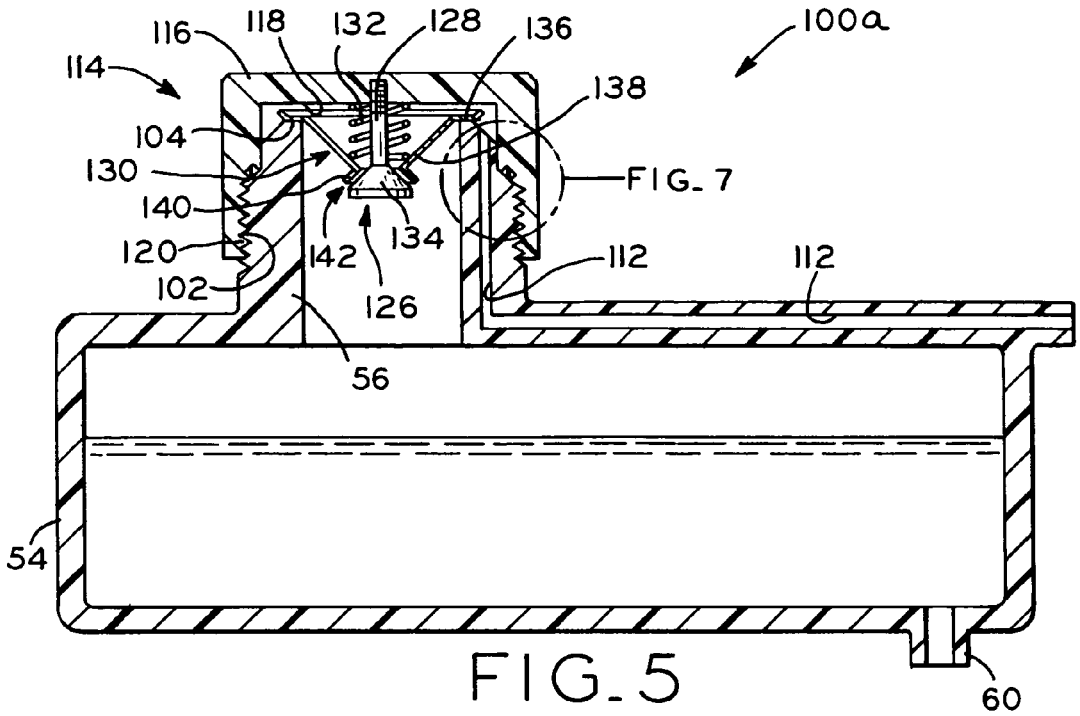
FIG. 5 is a sectional view showing a fuel tank sealing and venting system according to another embodiment.
Figure 6:
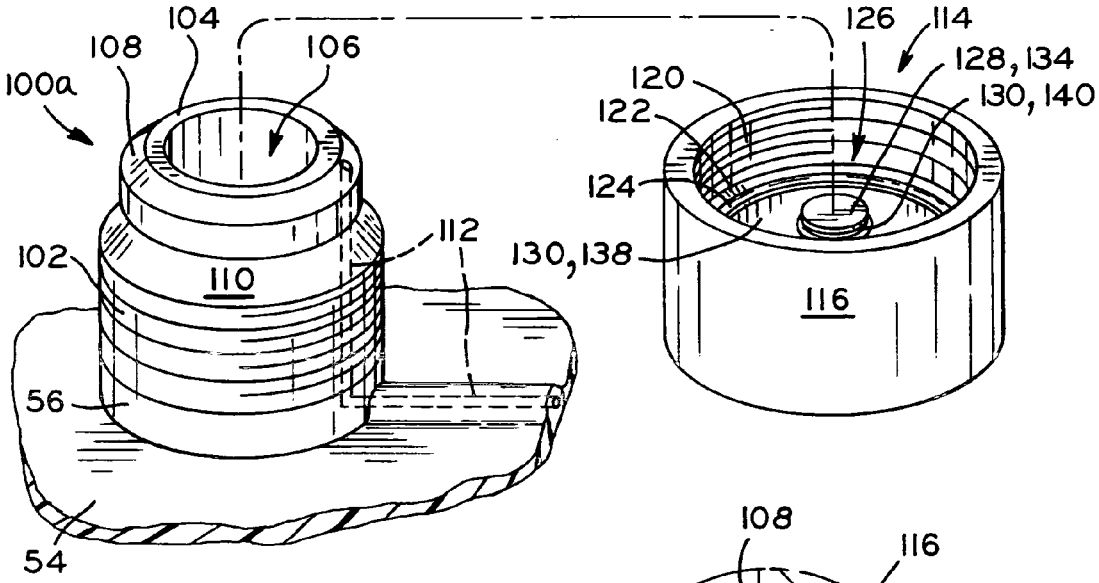
FIG. 6 is an exploded view of the fuel tank sealing and venting system of FIG. 5.
Figure 7:
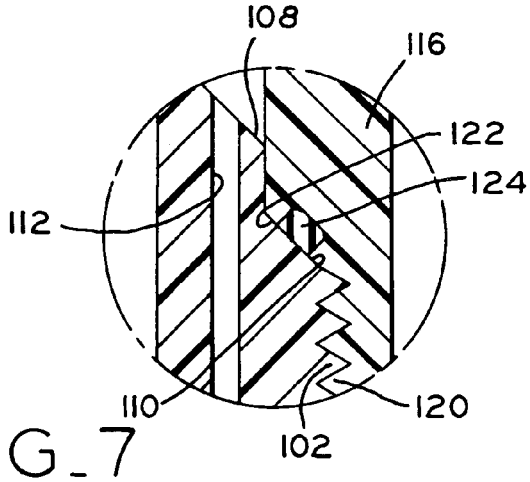
FIG. 7 is an enlarged fragmentary view of a portion of FIG. 5.

Fuel tank sealing and venting assembly 100*a* is shown in FIGS. 5–7. In this embodiment, fuel tank 54 includes annular filler neck 56 having external threads 102 therearound, and outer rim 104 defining fuel fill opening 106 through which fuel is filled into fuel tank 54. Filler neck 56 includes a first, downwardly slanted surface 108 outwardly adjacent outer rim 104, and a second, sealing surface 110 outwardly adjacent surface 108. Vent passage 112 is formed within filler neck 56, and includes one end opening to surface 108, and an opposite end in communication with vent line 64 of evaporative emissions control system 30*a* or 30*b* described above. Vent passage 112 may be integrally formed within filler neck 56 and fuel tank 54 when fuel tank 54 and filler neck 56 are molded, or alternatively, may comprise one or more bores formed in fuel tank and filler neck 56 after same is molded. As best shown in FIG. 6, surface 108 of filler neck 56, into which vent passage 112 opens, is disposed outwardly of outer rim 104 and fuel fill opening 106 such that when fuel tank 54 is filled, fuel passes only through fuel fill opening 106 and not into vent passage 112.

Fuel tank cap 114 includes a cup-shaped body 116 having inner surface 118 with internal threads 120 for threadably engaging external threads 102 of filler neck 56. As shown in FIG. 7, fuel tank cap 114 also includes sealing surface 122 which sealingly engages sealing surface 110 of filler neck 56 when fuel tank cap 114 is threaded thereon, thereby sealing fuel tank 54 to prevent fuel vapors from escaping from fuel tank 54 through fuel tank cap 114 into the atmosphere. Additionally, as shown in FIG. 7, sealing surface 110 of filler neck 56 or sealing surface 122 of fuel tank cap 114 may include O-ring 124 for providing a seal between filler neck 56 and fuel tank cap 114.

Referring to FIG. 5, fuel tank cap 114 additionally includes valve assembly 126, including valve stem 128, cone member 130, and spring 132. Valve stem 128 extends from inner surface 118 of body 116 of fuel tank cap, and terminates in head portion 134. Cone member 130 includes upper rim 136, tapered portion 138, and sealing portion 140. As shown in FIG. 6, when fuel tank cap 114 is not attached to filler neck 56, sealing portion 140 engages head portion 134 of valve stem 128, and spring 132 is disposed around valve stem 128 between inner surface 118 of fuel tank cap 114 and tapered portion 138 of cone member 130.

When fuel tank cap 114 is threaded onto filler neck 56, upper rim 136 of cone member 130 seats against outer rim 104 of filler neck 56 to prevent downward movement of cone member 130. Thereafter, as fuel tank cap 114 is threaded further onto filler neck 56, valve stem 128 moves downwardly therewith, and spring 132 is compressed between inner surface 118 of fuel tank cap 114 and tapered portion 138 of cone member 130, biasing sealing portion 140 of cone member 130 outwardly from head portion 134 of valve stem 128, creating an annular vent opening 142 therebetween. Concurrently therewith, sealing surface 122 of fuel tank cap 114 engages sealing surface 110 of filler neck 56 as described above to seal the connection between fuel tank cap 114 and filler neck 56.

In this manner, after fuel tank cap 114 is attached to filler neck 56, any fuel vapors within fuel tank 54 may pass through vent opening 142 into the space between cone member 130 and inner surface 118 of fuel tank cap 114, and thereafter between upper rim 136 of cone member 130 and inner surface 118 of fuel tank cap 114 and into vent passage 112. The fuel vapors thereafter may pass through vent passage 112 into vent line 64 as described above. Additionally, as the level of fuel within fuel tank 54 lowers as engine 32 is operated and fuel within fuel tank 54 is consumed, air may pass from carburetor 34 through vent line 62, vent passage 112, and fuel tank cap 114 in a reverse manner into fuel tank 54 as necessary.

Fuel tank cap 114 is configured such that any liquid fuel which splashes upwardly through vent opening 142 contacts one or more of tapered portion 138 of cone member 130, valve stem 128, spring 132, or inner surface 118 of fuel tank cap 114, and thereafter is directed downwardly by tapered portion 138 of cone member 130 to drip back into fuel tank 54 through vent opening 142.

Figure 8:
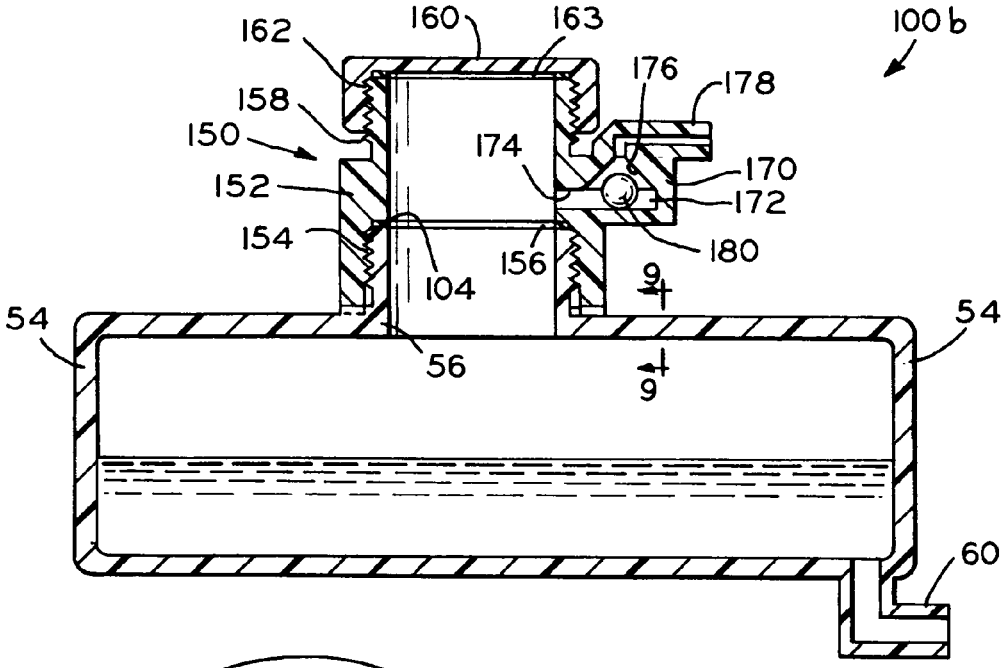
FIG. 8 is a sectional view of a fuel tank sealing and venting system according to another embodiment.
Figure 9:
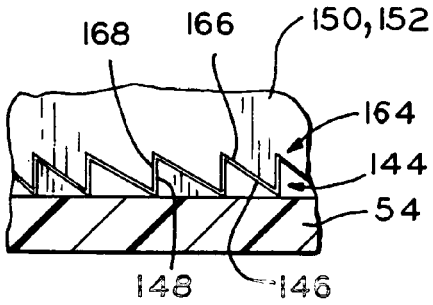
FIG. 9 is an enlarged fragmentary view of FIG. 8.
Figure 10:
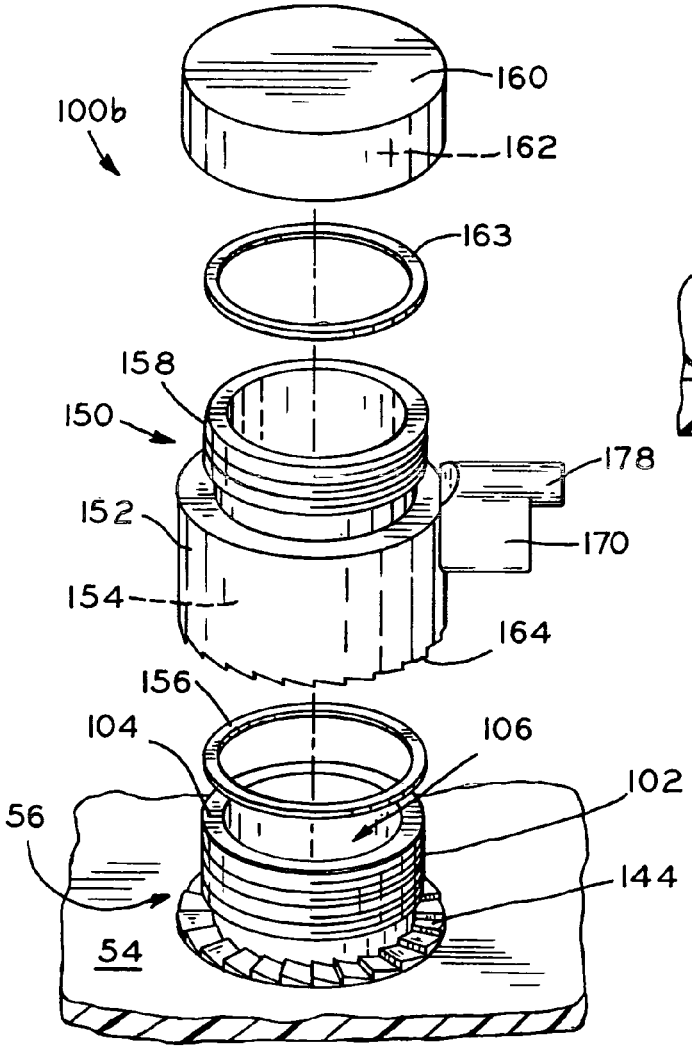
FIG. 10 is an exploded view of the fuel tank sealing and venting system of FIG. 8.

Fuel tank sealing and venting assembly 100*b* is shown in FIGS. 8–10. In this embodiment, fuel tank 54 includes filler neck 56 having external threads 102 and outer rim 104 defining fuel fill opening 106 through which fuel may be filled into fuel tank 54. Additionally, a plurality of locking ridges 144 are formed on fuel tank 54 around the base of filler neck 56 which, as shown in FIG. 9, each include ramp surface 146 and lock surface 148.

Vent assembly 150 includes a generally annular body 152 having internal threads 154 and gasket 156 at a lower end thereof, wherein internal threads 154 threadably engage external threads 102 of filler neck 56 when vent assembly 150 is attached to filler neck 56, and wherein gasket 156 engages outer rim 104 of filler neck 56 to provide a seal between vent assembly 150 and filler neck 56. Vent assembly 150 also includes external threads 158 at an upper end thereof for threadably receiving internal threads 162 of cap 160 when cap 160 is threadably attached to vent assembly 150, wherein gasket 163 of cap 160 engages vent assembly 150 to provide a seal between vent assembly 150 and cap 160.

Vent assembly 150 additionally includes locking ridges 164 disposed around a lower end thereof, each locking ridge 164 including ramp surface 166 and lock surface 168. Referring to FIGS. 9 and 10, as vent assembly 150 is initially threaded onto filler neck 56, locking ridges 146 of vent assembly 150 engage locking ridges 146 of fuel tank 54. Specifically, as shown in FIG. 9, ramp surfaces 166 of locking ridges 164 of vent assembly 150 ride over ramp surfaces 146 of locking ridges 144 of fuel tank 54 until vent assembly 150 is threaded fully downwardly onto filler neck 56, wherein lock surfaces 168 of locking ridges 164 of vent assembly 150 engage lock surfaces 148 of locking ridges 144 of fuel tank 54 to prevent vent assembly 150 from being rotated in an opposite direction and unthreaded from filler neck 56. In this manner, when vent assembly 150 is initially attached to filler neck 56, vent assembly 150 is rotationally locked into place with respect to fuel tank 54 such that, when cap 160 is rotated to threadingly detach same from vent assembly 150 in order to fill fuel tank 54, engagement between locking ridges 164 of vent assembly 150 and locking ridges 144 of fuel tank 54 prevent movement of vent assembly 150.

Additionally, vent assembly 150 includes valve housing 170, which includes valve chamber 172 having inlet 174 in communication with fuel tank 54, and valve seat 176 in communication with vent port 178 to which is connected vent line 62 of evaporative emissions control system 30*a* or 30*b* described above. Ball 174 is disposed within valve chamber 172, and normally rests on lower edge of valve chamber 172 away from valve seat 176, such that fuel tank 54 is in communication with vent port 178 through valve chamber. In this manner, any fuel vapors within fuel tank 54 may pass through valve chamber 172, through vent port 178, and into vent line 64 as described above. Additionally, as the level of fuel within fuel tank 54 lowers as engine 32 is operated and fuel within fuel tank 54 is consumed, air may pass from carburetor 34 through vent line 62, vent port, and valve chamber 172 in a reverse manner into fuel tank 54 as necessary.

If fuel tank 54 is overfilled, or if any liquid fuel otherwise enters valve chamber 172 through inlet 174, ball 180 floats upon the fuel and seals valve seat 176 to prevent liquid fuel from entering vent line 62. In this manner, liquid fuel is prevented from passing from fuel tank 54 to carburetor 34 via vent line 64. Advantageously, vent assembly 150 provides a add-on type vent assembly which may be attached to the filler neck of an existing fuel tank in order to configure same for use with evaporative emissions control system 30*a* or 30*b*, wherein locking ridges 144 of fuel tank 54 are the only additional feature for fuel tank 54.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a carburetor;

a fuel tank;

a fuel line fluidly communicating a volume of fuel within said fuel tank and said carburetor;

a vent line fluidly communicating an air space of said fuel tank and said carburetor; and a control valve responsive to vacuum produced within said engine during running of said engine, said control valve including a valve member movable between a first position in which said valve member prevents fluid communication between said fuel tank and said carburetor through at least one of said fuel line and said vent line, and a second position in which said valve member allows fluid communication between said fuel tank and said carburetor through said fuel line and said vent line.

2. The engine of claim 1, wherein movement of said valve member to said second position is responsive to vacuum produced within said carburetor during running of said engine.

3. The engine of claim 2, further comprising a vacuum line fluidly communicating said control valve and said carburetor, whereby vacuum within said carburetor is communicated to said control valve during running of said engine to move said valve member to said second position.

4. The engine of claim 1, wherein said valve member blocks fluid communication between said fuel tank and said carburetor through said fuel line and said vent line when said valve member is in said first position.

5. The engine of claim 1, wherein said control valve comprises a portion of said carburetor.

6. The engine of claim 1, wherein said control valve further includes a spring, said spring biasing said valve member to said first position.

7. The engine of claim 1, wherein said control valve allows fluid communication through said vent line prior to allowing fluid communication through said fuel line as said valve member moves from said first position to said second position.

8. The engine of claim 1, wherein said fuel tank includes an inlet to which a fuel tank cap is attached, said fuel tank cap sealing said inlet to prevent communication between said fuel tank and the atmosphere.

9. The engine of claim 1, wherein said vent line connects said fuel tank to an intake portion of said carburetor.

10. The engine of claim 1, wherein said fuel line connects said fuel tank to a fuel bowl of said carburetor.

11. A carburetor, comprising:

a carburetor body, comprising:

a throat;

a fuel bowl including a fuel inlet and a vent inlet separate from said fuel inlet; and a control valve including a valve member movable between a first position in which said valve member prevents fluid communication through at least one of said fuel inlet and said vent inlet and a second position in which said valve member allows fluid communication through said fuel inlet and said vent inlet.

12. The carburetor of claim 11, further comprising a fuel bowl in fluid communication with said fuel inlet and said vent inlet, said control valve disposed between said fuel bowl and said fuel and vent inlets.

13. The carburetor of claim 11, wherein control valve comprises a bore in said carburetor body, said valve member slidably disposed within said bore.

14. The carburetor of claim 11, further comprising a vacuum passage fluidly communicating said throat and said control valve, said valve member movable from said first position to said second position responsive to vacuum within said throat.

15. The carburetor of claim 11, wherein said valve member is connected to a bail assembly, whereby actuation of said bail assembly moves said valve member from said first position to said second position.

16. The carburetor of claim 11, wherein said control valve further includes a spring, said spring biasing said valve member to said first position.

17. The carburetor of claim 11, wherein said control valve allows fluid communication through said vent inlet prior to allowing fluid communication through said fuel inlet as said control valve moves from said first position to said second position.

18. A method of operating an internal combustion engine including a fuel tank and a carburetor, comprising the steps of:

opening a control valve responsive to vacuum produced within the engine substantially contemporaneously with starting the engine to allow fluid communication between a volume of fuel and an air space within the fuel tank and the carburetor through a vent line and through a fuel line, respectively; and closing the control valve substantially contemporaneously with engine shut down to prevent communication between the fuel tank and the carburetor through at least one of the vent line and the fuel line.

19. The method of claim 18, wherein said opening step further comprises allowing fluid communication through said vent line prior to allowing fluid communication through said fuel line.

20. An internal combustion engine, comprising:

an intake system;

a fuel tank including a filler neck with an inlet, a fuel outlet, and a vent passage formed at least partially within said filler neck, at least another portion of said vent passage is formed within a wall of said fuel tank, said fuel outlet and said vent passage each fluidly communicating said fuel tank with said intake system;

a fuel tank cap removably attached to said filler neck and preventing passage of fluid from said fuel tank to the atmosphere.

21. The engine of claim 20, wherein said filler neck and said fuel tank cap having cooperating threads in engagement with one another.

22. The engine of claim 21, wherein said fuel tank cap and said filler neck include cooperating surfaces, said surfaces sealingly engagable with one another when said fuel tank cap is attached to said filler neck.

23. The engine of claim 21, wherein vent passage includes an opening adjacent an outer rim of said filler neck.

24. The engine of claim 20, wherein said fuel tank cap includes a vent assembly, said vent assembly allowing fluid communication between an interior said fuel tank and said intake system through said vent passage when said fuel tank cap is attached to said inlet.

25. An internal combustion engine, comprising:

an intake system;

a fuel tank having an inlet and containing liquid fuel and fuel vapors therein;

a vent assembly attached to said inlet, said vent assembly in fluid communication with said intake system and including a fuel-responsive valve normally disposed in a first position and allowing passage of fuel vapors from said fuel tank to said intake system, said valve responsive to contact with liquid fuel to move to a second position in which passage of liquid fuel from said fuel tank to said intake system is prevented; and a removable fuel tank cap sealingly attached to said vent assembly, whereby liquid fuel and fuel vapors from said fuel tank are prevented from passing from said fuel tank to the atmosphere.

26. The engine of claim 25, wherein said fuel tank inlet comprises a filler neck extending from said fuel tank, said vent assembly screw-threadingly attached to said filler neck.

27. The engine of claim 26, wherein said fuel tank and said vent assembly include cooperating engagement structure locking said vent assembly to said fuel tank upon screw-threaded attachment of said vent assembly to said filler neck.

28. The engine of claim 25, wherein said vent assembly and said fuel tank cap are screw-threadingly attached to one another.

29. The engine of claim 25, wherein said fuel-responsive valve includes a valve seat and a float, said float not engaging said valve seat in said first valve position, said float engaging said valve seat in said second position by floating on liquid fuel.

30. An internal combustion engine, comprising:

a carburetor;

a fuel tank containing liquid fuel and fuel vapors and supplying liquid fuel to said carburetor and fuel vapors to said engine;

a control valve responsive to vacuum produced within said engine during running of said engine, said control valve including a valve member movable between a first position corresponding to engine shutdown in which said valve member blocks both the supply of liquid fuel from said fuel tank to said carburetor and the supply of fuel vapors from the fuel tank to said engine, and a second position corresponding to running of the engine in which said valve member allows both the supply of liquid fuel from said fuel tank to said carburetor and the supply of fuel vapors from said fuel tank to said engine.

31. The engine of claim 30, wherein said fuel tank supplies fuel vapors to at least one of an intake passage and a fuel bowl of said carburetor.

32. The engine of claim 30, wherein said fuel tank supplies liquid fuel to said carburetor and fuel vapors to said engine via separate fuel and vent lines, respectively, said control valve associated with said fuel and vent lines.

33. The engine of claim 30, further comprising a vacuum line fluidly communicating said control valve and said carburetor, whereby vacuum within said carburetor is communicated to said control valve during running of said engine to move said valve member to said second position.

34. The engine of claim 30, wherein said control valve comprises a portion of said carburetor.

35. An internal combustion engine, comprising:

a carburetor;

a fuel tank;

separate fuel and vent lines fluidly communicating said fuel tank and said carburetor, said fuel line fluidly communicating a volume of fuel within said fuel tank with said carburetor and said vent line fluidly communication an air space within said fuel tank with said carburetor; and a housing containing a fuel valve member and a vent valve member each responsive to vacuum produced within said engine during running of said engine, said valve members movable between first positions corresponding to engine shutdown in which said valve members prevent fluid communication between said fuel tank and said carburetor through said fuel line and said vent line, and second positions corresponding to running of said engine in which said valve members allow fluid communication between said fuel tank and said carburetor through said fuel line and said vent line, respectively.

36. The engine of claim 35, further comprising a vacuum line fluidly communicating said housing and said carburetor, whereby vacuum within said carburetor is communicated to said housing during running of said engine to move said valve members to said second positions.

37. The engine of claim 35, wherein said housing comprises a portion of said carburetor.

38. An internal combustion engine, comprising:

a fuel tank containing liquid fuel and fuel vapors;

a carburetor, comprising:

a carburetor body having an air intake passage;

a fuel inlet in communication with the liquid fuel within said fuel tank, and a vent inlet, in fluid communication with the fuel vapors within said fuel tank; and a control valve responsive to vacuum produced within said engine during running of said engine, including a valve member movable between a first position corresponding to engine shutdown in which said valve member prevents fluid communication from said fuel tank to said carburetor through at least one of said fuel inlet and said vent inlet, and a second position corresponding to running of said engine in which said valve member allows fluid communication from said fuel tank to said carburetor through said fuel inlet and said vent inlet.

39. The engine of claim 38, wherein said carburetor further comprises a fuel bowl in fluid communication with said fuel inlet and said vent inlet, said control valve disposed between said fuel bowl and said fuel and vent inlets.

40. The engine of claim 38, wherein said carburetor includes a vacuum passage fluidly communicating said air intake passage and said control valve, said valve member movable from said first position to said second position responsive to vacuum within said air intake passage.

* * * * *